US008641964B2

(12) United States Patent
Lewis et al.

(10) Patent No.: US 8,641,964 B2
(45) Date of Patent: Feb. 4, 2014

(54) SOLDER ALLOY

(75) Inventors: Brian G. Lewis, Branford, CT (US); Bawa Singh, Voorhees, NJ (US); John Laughlin, Tucson, AZ (US); Ranjit Pandher, Plainsboro, NJ (US)

(73) Assignee: Fry's Metals, Inc., South Plainfield, NJ (US)

( * ) Notice: Subject to any disclaimer, the term of this patent is extended or adjusted under 35 U.S.C. 154(b) by 431 days.

(21) Appl. No.: 12/036,497

(22) Filed: Feb. 25, 2008

(65) Prior Publication Data

US 2008/0159903 A1 Jul. 3, 2008

Related U.S. Application Data

(63) Continuation-in-part of application No. PCT/GB2006/003167, filed on Aug. 24, 2006.

(60) Provisional application No. 60/896,120, filed on Mar. 21, 2007, provisional application No. 60/710,917, filed on Aug. 24, 2005.

(51) Int. Cl.
*C22C 13/00* (2006.01)
*C22C 13/02* (2006.01)

(52) U.S. Cl.
USPC ..... 420/560; 420/557; 420/561

(58) Field of Classification Search
USPC ..... 420/557, 560, 561
See application file for complete search history.

(56) References Cited

U.S. PATENT DOCUMENTS

| | | | |
|---|---|---|---|
| 5,837,191 | A | 11/1998 | Gickler |
| 6,139,979 | A | 10/2000 | Takaoka et al. |
| 6,231,691 | B1 | 5/2001 | Anderson et al. |
| 6,517,602 | B2 | 2/2003 | Sato et al. |
| 6,554,180 | B1 | 4/2003 | Katoh et al. |
| 7,282,175 | B2 | 10/2007 | Amagai et al. |
| 2007/0036671 | A1 | 2/2007 | Albrecht et al. |

FOREIGN PATENT DOCUMENTS

| | | |
|---|---|---|
| EP | 1088615 | 4/2001 |
| EP | 1213089 | 6/2002 |
| EP | 1231015 | 8/2002 |

(Continued)

OTHER PUBLICATIONS

Amami et al., English machine translation of JP 2004-261863 A, Sep. 2004.*

(Continued)

*Primary Examiner* — Roy King
*Assistant Examiner* — Caitlin Kiechle
(74) *Attorney, Agent, or Firm* — Senniger Powers LLP

(57) ABSTRACT

An alloy suitable for use in a ball grid array or chip scale package comprising from 0.05-1.5 wt. % copper, from 0.1-2 wt. % silver, from 0.005-0.3 wt % nickel, from 0.003-0.3 wt % chromium, from 0-0.1 wt. % phosphorus, from 0-0.1 wt. % germanium, from 0-0.1 wt. % gallium, from 0-0.3 wt. % of one or more rare earth elements, from 0-0.3 wt. % indium, from 0-0.3 wt. % magnesium, from 0-0.3 wt. % calcium, from 0-0.3 wt. % silicon, from 0-0.3 wt. % aluminum, from 0-0.3 wt. % zinc, from 0-2 wt. % bismuth, from 0-1 wt. % antimony, from 0-0.2 wt % manganese, from 0-0.3 wt % cobalt, from 0-0.3 wt % iron, and from 0-0.1 wt % zirconium, and the balance tin, together with unavoidable impurities.

40 Claims, 3 Drawing Sheets

(56) References Cited

FOREIGN PATENT DOCUMENTS

| | | | |
|---|---|---|---|
| EP | 1245328 | | 10/2002 |
| EP | 1273384 | | 1/2003 |
| EP | 1410871 | | 4/2004 |
| JP | 10034376 | | 2/1998 |
| JP | 2000280090 | | 10/2000 |
| JP | 2001071173 | | 3/2001 |
| JP | 2002239780 | | 8/2002 |
| JP | 2003001482 | | 1/2003 |
| JP | 2003230980 | | 8/2003 |
| JP | 2004261863 | | 9/2004 |
| WO | 2004/096484 | A2 | 11/2004 |
| WO | 2005048303 | | 5/2005 |

OTHER PUBLICATIONS

Kim, K.S. et al., "Effects of Fourth Alloying Additive on Microstructures and Tensile Properties of Sn—Ag—Cu Alloy and Joints with Cu", Microelectronics Reliability, Feb. 2003, pp. 259-267, vol. 43, Issue 2.

International Search Report, PCT/GB2006/003167, dated May 21, 2007, 6 pages.

Written Opinion, PCT/GB2006/003167, dated May 21, 2007, 13 pages.

Abstract of JP2004261863; Sep. 24, 2004.

Abstract of JP2001071173; Mar. 21, 2001.

Abstract of JP2003230980; Aug. 19, 2003.

Abstract of JP2002239780; Aug. 28, 2002.

Abstract of WO2004096484; Nov. 11, 2004.

Abstract of JP2000280090; Oct. 10, 2000.

Abstract of JP2003001482; Jan. 8, 2003.

Abstract of JP10034376; Feb. 10, 1998.

* cited by examiner

SOLDER ALLOY

REFERENCE TO RELATED APPLICATIONS

This application is a continuation-in-part of PCT application PCT/GB2006/003167, filed Aug. 24, 2006 and claiming priority to U.S. provisional application 60/710,917, filed Aug. 24, 2005; and this application also claims priority to U.S. provisional application 60/896,120, filed Mar. 21, 2007, the entire disclosures of which are incorporated herein by reference.

FIELD OF THE INVENTION

The present invention relates to an alloy and, in particular, a lead-free solder alloy. The alloy is particularly, though not exclusively, suitable for use in ball grid arrays and chip scale packages in the form of solder spheres.

BACKGROUND OF THE INVENTION

For environmental reasons, there is an increasing demand for lead-free replacements for lead-containing conventional alloys. Many conventional solder alloys are based around the tin-copper eutectic composition, Sn-0.7 wt. % Cu, and tin-silver eutectic composition, 96.5 wt. % Sn-3.5 wt. % Ag.

A ball grid array joint is a bead of solder between two substrates, typically circular pads. Arrays of these joints are used to mount chips on circuit boards.

The drop shock reliability of solder joints has become a major issue for the electronic industry partly because of the ever increasing popularity of portable electronics and partly due to the transition to lead-free solders. Most of the commonly recommended lead-free solders are high tin alloys which have relatively higher strength and modulus. This plays a critical role in the reliability of lead-free solder joints. Further, even though metallurgically, it is the tin in the solder alloys that principally participates in the solder joint formation, details of the IMC (intermetallic compound) layers formed with tin-lead and lead-free alloys are different. The markedly different process conditions for tin-lead and lead-free alloys also bear on solder joint quality. Brittle failure of solder joints in drop shock occurs at or in the interfacial IMC layer(s). This is due to the inherent brittle nature of the IMC, defects within or at IMC interfaces or transfer of stress to the interfaces as a result of the low ductility of the bulk solder.

There are a number of requirements for a solder alloy to be suitable for use in ball grid arrays (BGA) and chip scale packages (CSP). First, the alloy must exhibit good wetting characteristics in relation to a variety of substrate materials such as copper, nickel, nickel phosphorus, nickel boron ("electroless nickel"). Solder alloys tend to dissolve the substrate and to form an intermetallic compound at the interface with the substrate. For example, tin in the solder alloy will react with the substrate at the interface to form an intermetallic. If the substrate is copper, then a layer of $Cu_6Sn_5$ will be formed. Such a layer typically has a thickness of from a fraction of a micron to a few microns. At the interface between this layer and the copper substrate an intermetallic compound of $Cu_3Sn$ may be present. Such an intermetallic compound may result in a brittle solder joint. In some cases, voids occur, which may contribute to premature fracture of a stressed joint.

Other important factors are (i) the presence of intermetallics in the alloy itself, which results in stronger mechanical properties, (ii) oxidation resistance in multiple reflow, (iii) drossing rate, and (iv) alloy stability. This latter consideration is important for applications where the alloy is held in a tank or bath for long periods of time.

SUMMARY OF THE INVENTION

The present invention aims to address at least some of the problems associated with the prior art and to provide an improved solder alloy.

In one embodiment, the present invention provides an alloy suitable for use in a ball grid array or chip scale package, the alloy comprising:

from 0.05-1.5 wt. % copper;
from 0.1-2 wt. % silver;
from 0.005-0.3 wt. % nickel;
from 0.003-0.3 wt. % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0-0.3 wt. % calcium;
from 0-0.3 wt. % silicon;
from 0-0.3 wt. % aluminium;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE EMBODIMENT(S) OF THE INVENTION

Figure 1:
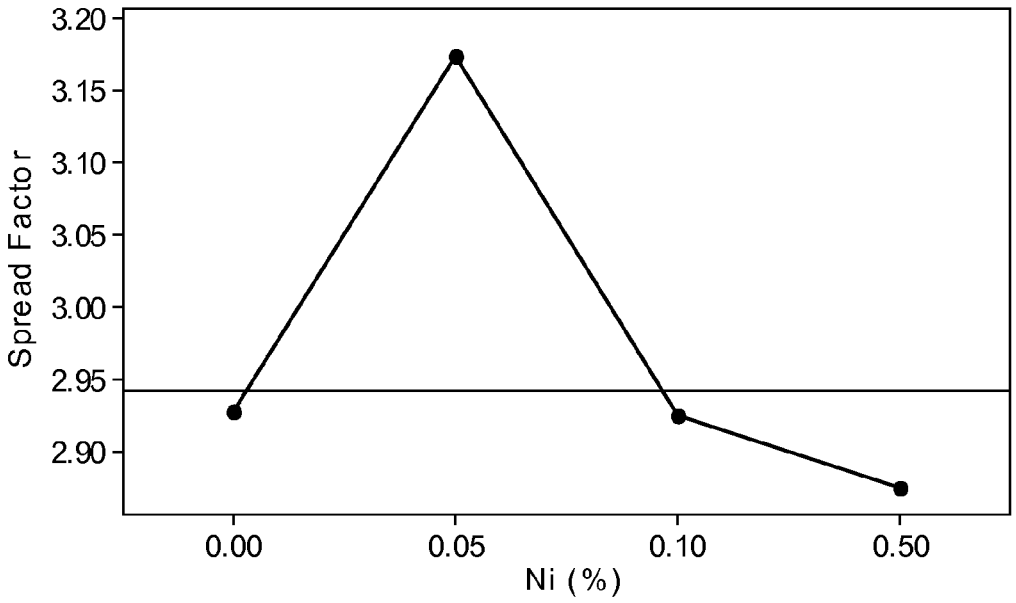
FIG. 1 is a graph showing the effect of Ni on solder spread in SnAgCu alloy on Cu-OSP. The data were obtained according to the method described in Example 17.

The present invention will now be further described. In the following passages different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Copper forms an eutectic with tin, lowering the melting point and increasing the alloy strength. A copper content in the hyper-eutectic range increases the liquidus temperature but further enhances the alloy strength. In one embodiment, the alloy preferably comprises from 0.1 to 1 wt. % Cu, more preferably from 0.1 to 0.9 wt. % Cu, still more preferably from 0.1 to 0.8 wt. % Cu. In another embodiment, the alloy preferably comprises from 0.15 to 1 wt. % Cu, more preferably from 0.5 to 0.9 wt. % Cu, still more preferably from 0.6 to 0.8 wt. % Cu. Specific examples of preferred alloys are ones containing 0.1 wt. % Cu, 0.5 wt. % Cu, and 0.7 wt. % Cu.

Silver lowers the melting point and improves the wetting properties of the solder to copper and other substrates. In one embodiment, the alloy preferably comprises from 0.1 to 3 wt. % Ag, more preferably from 0.1 to 2 wt. % Ag, more preferably from 0.1 to 1.5 wt. % Ag. Most preferably, the alloy comprises from 0.1 to 1 wt. % Ag. Preferred ranges within this range are from 0.1 to 0.5 wt. % Ag, more preferably from 0.1 to 0.4 wt. % Ag, still more preferably from 0.1 to 0.3 wt. % Ag. The lower limit for the Ag range may be raised to 0.2 wt. %. Specific examples of preferred alloys are ones containing 0.3 and 1 wt. % Ag. A low silver content has been found to be beneficial because it provides reduced alloy stiffness with the corollary of improved drop shock resistance. In drop shock or other high strain rate testing the stiffness and acoustic impedance play a primary role in determining how stress is transferred through the solder alloy to the interface (i.e. the solder/IMC/substrate). Preferably such stress or stress waves are damped by the alloy. It has been found that low silver contents improve the alloy characteristics in this respect. Furthermore, it has been found that a $Ag_3Sn$ intermetallic typically forms as high aspect ratio laths and plates. In forming a solder joint the $Ag_3Sn$ IMC has a tendency to nucleate at the interfaces (i.e. the solder/IMC/substrate). These structures can act as stress risers thereby further embrittling the solder joint. For these reasons, the silver content in the alloy according to the present invention is preferably ≤2 wt. %, more preferably ≤1.5 wt. %, still more preferably ≤1 wt. %. Such alloys have been found to be more resistant to high strain rate (drop shock) failure. In one embodiment, the silver content in the alloy may be ≤0.4 wt. %, more preferably ≤0.35 wt. %, still more preferably ≤0.3 wt. %.

The presence of nickel in the alloy is beneficial in terms of mechanical properties (as demonstrated by improved ball pull) and also solder spread. The alloy may comprise from 0.005 to 0.3 wt % nickel, preferably from 0.01 to 0.3 wt % nickel, more preferably 0.02 to 0.3 wt %, more preferably 0.02 to 0.2 wt %, still more preferably 0.03 to 0.15 wt %, still more preferably 0.04 to 0.12 wt %. A particularly advantageous range is 0.04 to 0.08 wt % nickel. Ball pull results indicate that there is a reproducible correlation between improved ball pull and solder spread and the optimum nickel content in these respects has been found to be 0.03 to 0.07 wt %, preferably 0.04 to 0.06 wt %, more preferably approximately 0.05 wt %. The same is also confirmed by drop shock test results. The performance with 0.5 wt % nickel is poorer than 0.05% nickel (however, good results are also obtained at approximately 0.1 wt % nickel). For this reason, the nickel content should not exceed approximately 0.3 wt % nickel.

The presence of chromium in the alloy is also beneficial in terms of mechanical properties (as demonstrated by improved ball pull). However, chromium on its own (i.e. without nickel) has little or no effect on solder spread. Surprisingly, however, in conjunction with nickel an improvement in solder spread is observed. The alloy may comprise from 0.003 to 0.3 wt. % chromium, preferably from 0.005 to 0.3 wt % chromium, more preferably 0.01 to 0.2 wt %, more preferably 0.01 to 0.1 wt %, still more preferably 0.01 to 0.07 wt %. The optimum is 0.02 to 0.06 wt % chromium, preferably 0.02 to 0.04 wt %, more preferably approximately 0.03 wt %. However, good results are also obtained at approximately 0.05 wt %. In the manufacture of the alloy, in order to achieve the required alloying effect, it is advantageous to add the chromium to the tin and other components by first alloying some or all of the chromium with some or all of the copper.

Nickel and chromium may act as intermetallic compound growth modifiers and grain refiners. For example, while not wishing to be bound by theory, it is believed that nickel forms an intermetallic with tin and with the copper to form a CuNiSn intermetallic and the presence of the low solubility elements in the intermetallic slows the diffusion of Cu and thereby reduces the amount of IMC that forms over time. It has been found that growth rates of the CuNiSn intermetallics are less than in nickel-free alloys.

Chromium has a low solubility in tin but alloys with copper. Chromium is therefore preferably alloyed via the copper component in the solder and thereby it is proposed that it will limit the formation of $Cu_6Sn_5$ IMC in the bulk solder. The presence of the intermetallics affects the microstructure developed on cooling the alloy from the molten to the solid state. A finer grain structure is observed, which further benefits the appearance and strength of the alloy.

Up to 0.3 wt % chromium in combination with up to 0.3 wt % nickel and up to 1 wt % silver results in an alloy with improved properties. In particular, it has been found that alloys containing the nickel and chromium additions have a reduced ball pull force for the so called Mode 2 failure. Mode 2 is the preferred failure mode. It is necking and tensile failure in the solder, not at the interface.

Chromium has also been found to soften the alloy and improve oxidation resistance. With regard to tarnish performance, a small quantity (~50 ppm) of phosphorus addition may advantageously be used. The presence of nickel in the alloy also provides reasonable protection against tarnish resistance of solder spheres.

The sum of nickel and chromium is preferably from 0.008 to 0.6 wt %, more preferably 0.01 to 0.2 wt %, still more preferably 0.01 to 0.15 wt %. The optimum combined amount of nickel and chromium is 0.05 to 0.12 wt %.

It has surprising been found that the presence of both nickel and chromium in the alloys according to the present invention has a very positive effect on mechanical properties. The addition of either nickel or chromium results in some improvement in mechanical properties, as demonstrated by high strain rate testing performance and ball pull data. However, it has been found that there is a synergistic effect between nickel and chromium: the collective effect of the nickel and chromium additions is greater than the sum of the individual effects. In particular, the alloys according to the present invention can show >80% reduction in mode 4 failures as demonstrated by drop shock evaluations.

The combination of nickel and chromium in the alloys according to present invention therefore offers high drop shock reliability and also improved solder spread.

If present, the alloy preferably comprises from 0.02-0.2 wt. % of at least one of cobalt and/or, iron, more preferably from 0.02-0.1 wt. % of at least one of cobalt and/or iron.

If present, the alloy preferably comprises from 0.005-0.3 wt. % magnesium. In this case, improved properties can be obtained by the presence of from 0.02-0.3 wt % Fe.

If present, the alloy preferably comprises from 0.01-0.15 wt % manganese, more preferably from 0.02-0.1 wt % manganese.

Cobalt, manganese, iron, antimony and zirconium may act as intermetallic compound growth modifiers and grain refiners.

Indium, zinc, magnesium, calcium, gallium and aluminium may act as diffusion compensators. The addition of appropriate fast diffusing species can be effective in balancing what otherwise would be a net atom flux away from, for example, the solder-substrate interface, resulting in void formation (Horsting or Kirkendall). Indium has been found to have a beneficial effect on solder wetting. Indium lowers the melting point of the solder. Indium may also act to reduce the formation of voids in the solder joint. Indium may also improve the strength of the Sn-rich matrix. Zinc has been found to act in a similar manner to indium. The alloy may optionally contain up to 0.3 wt. % indium, for example, 0.05 wt. %-0.3 wt. % indium, preferably from 0.1 to 0.2 wt. % indium.

The alloy may optionally comprise from 0.01-0.3 wt. % calcium, more preferably from 0.1-0.2 wt. % calcium.

The alloy may optionally comprise from 0.01-0.3 wt. % silicon, more preferably from 0.1-0.2 wt. % silicon.

The alloy may optionally comprise from 0.01-0.3 wt. % zinc, more preferably from 0.1-0.2 wt. % zinc.

The alloy may optionally comprise from 0.05-1 wt. % antimony, more preferably from 0.1-0.5 wt. % antimony.

Aluminium (as well as chromium, germanium, silicon and phosphorous) may also be beneficial in terms of oxidation reduction. The alloy may optionally comprise from 0.008-0.3 wt. % aluminium, more preferably from 0.1-0.2 wt. % aluminium.

Phosphorus, germanium, and gallium may act as dross reducers. The alloy may optionally contain up to 0.1 wt. % of one or more of each of phosphorus, germanium, and gallium.

Bismuth may act to improve wetting and fatigue resistance. Bismuth can lower the solidus temperature and improve strength through precipitation hardening while suppressing the formation of large $Ag_3Sn$ IMC in the bulk solder. The alloys according to the present invention may contain up to 2 wt. % bismuth, more preferably up to 1 wt. %, still more preferably up to 0.5 wt. % bismuth, for example 0.05 to 0.5 wt. %.

If present, the alloy preferably comprises up to 0.05 wt. % of one or more rare earth elements. The one or more rare earth elements preferably comprise two or more elements selected from cerium, lanthanum, neodymium and praseodymium.

The alloys according to the present invention are lead-free or essentially lead-free. The alloys offer environmental advantages over conventional lead-containing solder alloys.

The alloys according to the present invention will typically be supplied as a solder sphere for CSP applications but may also be supplied as bar, stick or ingot, optionally together with a flux. The alloys may also be provided in the form of a wire, for example a cored wire, which incorporates a flux, a sphere or a preform cut or stamped from a strip or solder. These may be alloy only or coated with a suitable flux as required by the soldering process. The alloys may also be supplied as a powder blended with a flux to produce a solder paste.

The alloys according to the present invention may be used in molten solder baths as a means to solder together two or more substrates and/or for coating a substrate.

It will be appreciated that the alloys according to the present invention may contain unavoidable impurities, although, in total, these are unlikely to exceed 1 wt. % of the composition. Preferably, the alloys contain unavoidable impurities in an amount of not more than 0.5 wt. % of the composition, more preferably not more than 0.3 wt. % of the composition, still more preferably not more than 0.1 wt. % of the composition.

The alloys according to the present invention may consist essentially of the recited elements. It will therefore be appreciated that in addition to those elements which are mandatory (i.e. Sn, Cu, Ag, Ni, and Cr) other non-specified elements may be present in the composition provided that the essential characteristics of the composition are not materially affected by their presence.

The alloys will typically comprise at least 90 wt. % tin, preferably from 94 to 99.5% tin, more preferably from 95 to 99% tin, more preferably 97 to 99% tin, still more preferably 98 to 99% tin. Accordingly, the present invention further provides an alloy for use in a ball grid array or chip scale package, the alloy comprising:

from 95-99 wt % tin,
from 0.05-1.5 wt. % copper,
from 0.1-2 wt. % silver,
from 0.005-0.3 wt % nickel,
from 0.003-0.3 wt % chromium,
from 0-0.1 wt. % phosphorus,
from 0-0.1 wt. % germanium,
from 0-0.1 wt. % gallium,
from 0-0.3 wt. % of one or more rare earth elements,
from 0-0.3 wt. % indium,
from 0-0.3 wt. % magnesium,
from 0-0.3 wt. % calcium,
from 0-0.3 wt. % silicon,
from 0-0.3 wt. % aluminium,
from 0-0.3 wt. % zinc,
from 0-2 wt. % bismuth,
from 0-1 wt. % antimony,
from 0-0.2 wt. % manganese,
from 0-0.3 wt. % cobalt,
from 0-0.3 wt. % iron, and
from 0-0.1 wt. 5 zirconium,
together with unavoidable impurities.

The alloys according to the present invention are particularly well suited to applications involving ball grid arrays or chip scale packages. Accordingly, the present invention also provides for the use of a solder alloy as herein described in a ball grid array or chip scale package.

The following are examples of preferred alloy compositions in accordance with the present invention which show surprisingly good mechanical properties (eg high drop shock reliability) and also improved solder spread. The collective effect of the nickel and chromium additions is greater than the sum of the individual effects.

| | |
|---|---|
| Ag | 1 wt % |
| Cu | 0.5 wt % |
| Ni | 0.05 wt % or 0.10 wt % |
| Cr | 0.03 wt % |
| and remainder tin | |
| Ag | 1 wt % |
| Cu | 0.1 wt % |
| Ni | 0.05 wt % or 0.10 wt % |
| Cr | 0.03 wt % |
| and remainder tin | |
| Ag | 1 wt % |
| Cu | 0.1 wt % |
| Ni | 0.05 wt % or 0.10 wt % |
| Cr | 0.05 wt % |
| and remainder tin | |
| Ag | 0.3 wt % |
| Cu | 0.7 wt % |

-continued

| | |
|---|---|
| Ni | 0.05 wt % or 0.10 wt % |
| Cr | 0.03 wt % |
| and remainder tin | |
| Ag | 0.3 wt % |
| Cu | 0.7 wt % |
| Ni | 0.05 wt % or 0.10 wt % |
| Cr | 0.03 wt % |
| Bi | 0.1 wt % |
| and remainder tin | |

The present invention also provides for a ball grid array or chip scale package joint comprising the solder alloy composition as herein described.

Having described the invention in detail, it will be apparent that modifications and variations are possible without departing from the scope of the invention defined in the appended claims.

EXAMPLES

The following are non-limiting examples to further describe the present invention.

Example 1

An alloy was prepared by melting Sn in a cast iron crucible (alternatively a ceramic crucible can be used). To the molten Sn was added an alloy of Sn-3 wt % Cu, and alloys of Sn-5 wt % Ag and Sn-0.35 wt % Ni. These additions were made with the alloy bath temperature at 350° C. The bath was cooled to 300° C. for the addition of phosphorus in the form of an alloy Sn-0.3% P.

The alloy was sampled to verify the composition of

| | |
|---|---|
| Ag | 0.3 wt % |
| Cu | 0.7 wt % |
| P | 0.006 wt % |
| and remainder tin | |

The alloy composition was then jetted as a metal stream into an inerted vertical column. The metal stream was spherodised by the application of magnetostrictive vibrational energy applied through the melt pot and at or near the exit orifice.

Equally, the alloy composition could be punched and then spherodised as a sphere.

The alloy, provided in the form of a sphere, can be used in a ball grid array joint or chip scale package. Flux is printed or pin transferred to the pads of a CSP. The spheres are then pick and placed or shaken through a stencil onto the fluxed pads. The package is then reflowed in a standard reflow oven at a peak temperature of between 240° C. and 260° C.

Alloy and solder joint performance was assessed in packages aged at 150° C. for up to 1000 hours. IMC growth was measured by standard metallographic techniques. Mechanical ball pull testing was used to assess solder joint failure mode (brittle or ductile).

Example 2

The following alloy composition was prepared in a similar manner to Example 1 (all wt. %)

| | |
|---|---|
| Ag | 0.3 |
| Cu | 0.7 |
| Ni | 0.2 |
| P | 0.006 |
| Sn | balance |

This alloy may be provided in the form of a sphere and used in a ball grid array joint or chip scale package.

Example 3

The following alloy composition was prepared in a similar manner to Example 1.

| | |
|---|---|
| Ag | 0.3 |
| Cu | 0.7 |
| Co | 0.2 |
| P | 0.006 |
| Sn | balance |

This alloy may be provided in the form of a sphere and used in a ball grid array joint or chip scale package.

Example 4

The following alloy composition was prepared in a similar manner to Example 1.

| | |
|---|---|
| Ag | 0.3 |
| Cu | 0.7 |
| Cr | 0.05 |
| P | 0.006 |
| Sn | balance |

This alloy may be provided in the form of a sphere and used in a ball grid array joint or chip scale package.

Example 5

Alloys have been prepared corresponding to the compositions of Examples 1 to 4 where Ge is substituted for the phosphorus content.

Example 6

The following alloy composition was prepared in a similar manner to Example 1.

| | |
|---|---|
| Ag | 0.3 |
| Cu | 0.7 |
| Co | 0.2 |
| Sn | balance |

This alloy may be provided in the form of a sphere and used in a ball grid array joint or chip scale package.

Example 7

The following alloy composition was prepared in a similar manner to Example 1.

| | |
|---|---|
| Ag | 0.3 |
| Cu | 0.7 |
| Ni | 0.10 |
| Ge | 0.10 |
| P | 0.006 |
| Sn | balance |

This alloy may be provided in the form of a sphere and used in a ball grid array joint or chip scale package.

Example 8

The following alloy composition was prepared in a similar manner to Example 1.

| | |
|---|---|
| Ag | 1.1 |
| Cu | 0.5 |
| Fe | 0.25 |
| Mg | 0.1 |
| Sn | balance |

This alloy may be provided in the form of a sphere and used in a ball grid array joint or chip scale package.

Example 9

The following alloy composition was prepared in a similar manner to Example 1.

| | |
|---|---|
| Ag | 2 |
| Cu | 0.5 |
| Co | 0.2 |
| Sn | balance |

This alloy may be provided in the form of a sphere and used in a ball grid array joint or chip scale package.

Example 10

The following alloy composition was prepared in a similar manner to Example 1.

| | |
|---|---|
| Ag | 3 |
| Cu | 0.5 |
| Cr | 0.05 |
| Sn | balance |

This alloy may be provided in the form of a sphere and used in a ball grid array joint or chip scale package.

Example 11

The following alloy composition was prepared in a similar manner to Example 1.

| | |
|---|---|
| Ag | 0.3 |
| Cu | 0.7 |
| Ni | 0.2% |
| Sn | balance |

This alloy may be provided in the form of a sphere and used in a ball grid array joint or chip scale package.

Example 12

The following alloy composition was prepared in a similar manner to Example 1.

| | |
|---|---|
| Ag | 0.3 |
| Cu | 0.7 |
| Fe | 0.1 |
| Mg | 0.05 |
| Sn | balance |

This alloy may be provided in the form of a sphere and used in a ball grid array joint or chip scale package.

Example 13

The following alloy composition was prepared in a similar manner to Example 1.

| | |
|---|---|
| Ag | 0.3 |
| Cu | 0.7 |
| Cr | 0.05 |
| Co | 0.2 |
| Sn | balance |

This alloy may be provided in the form of a sphere and used in a ball grid array joint or chip scale package.

Example 14

The following alloy composition was prepared in a similar manner to Example 1.

| | |
|---|---|
| Ag | 0.3 |
| Cu | 0.7 |
| Cr | 0.05 |
| Ni | 0.2 |
| Sn | balance |

This alloy may be provided in the form of a sphere and used in a ball grid array joint or chip scale package.

Example 15

The following alloy composition was prepared in a similar manner to Example 1.

| | |
|---|---|
| Ag | 0.3 |
| Cu | 0.7 |
| Cr | 0.05 |
| Fe | 0.2 |
| Sn | balance |

This alloy may be provided in the form of a sphere and used in a ball grid array joint or chip scale package.

Example 16

The following alloy composition was prepared in a similar manner to Example 1.

| | |
|---|---|
| Ag | 0.3 |
| Cu | 0.7 |
| Cr | 0.05 |
| Fe | 0.2 |
| Mg | 0.1 |
| Sn | balance |

This alloy may be provided in the form of a sphere and used in a ball grid array joint or chip scale package.

Example 17

Empirical Testing of Solder Alloys

Figure 2A:
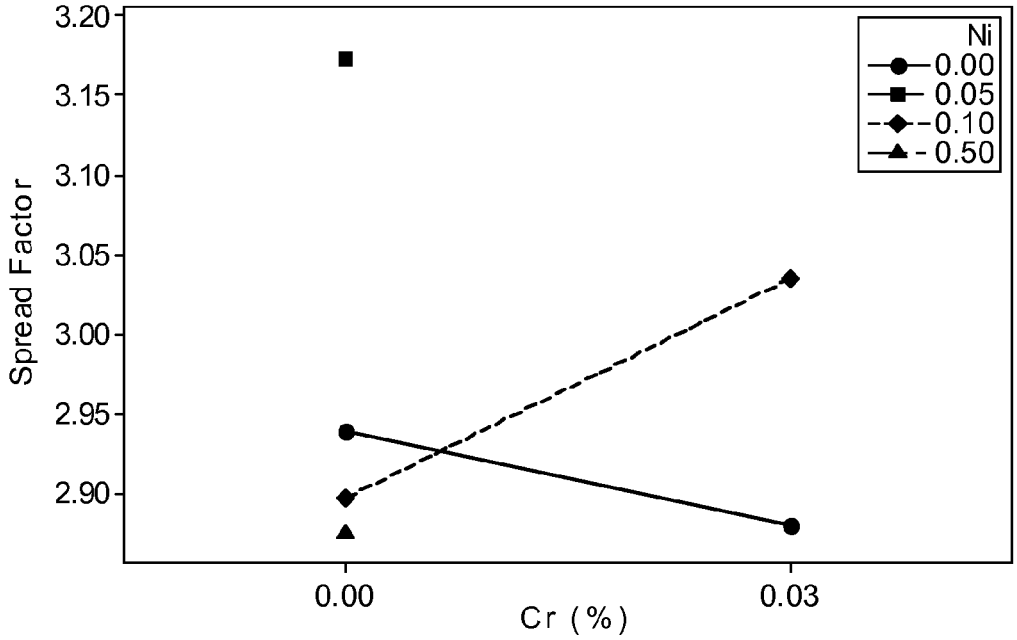
FIGS. 2*a* and 2*b* are graphs showing the effect of Ni and Cr on solder spread for SnAgCu alloys on Cu-OSP. The data were obtained according to the method described in Example 17.
Figure 2B:
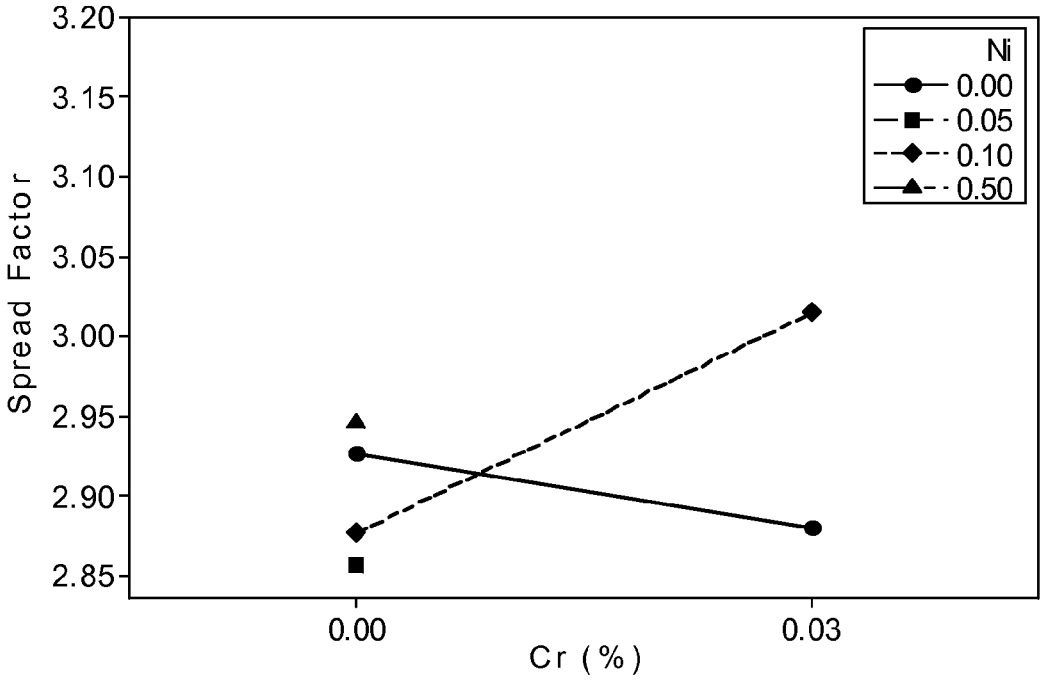
Figure 3:
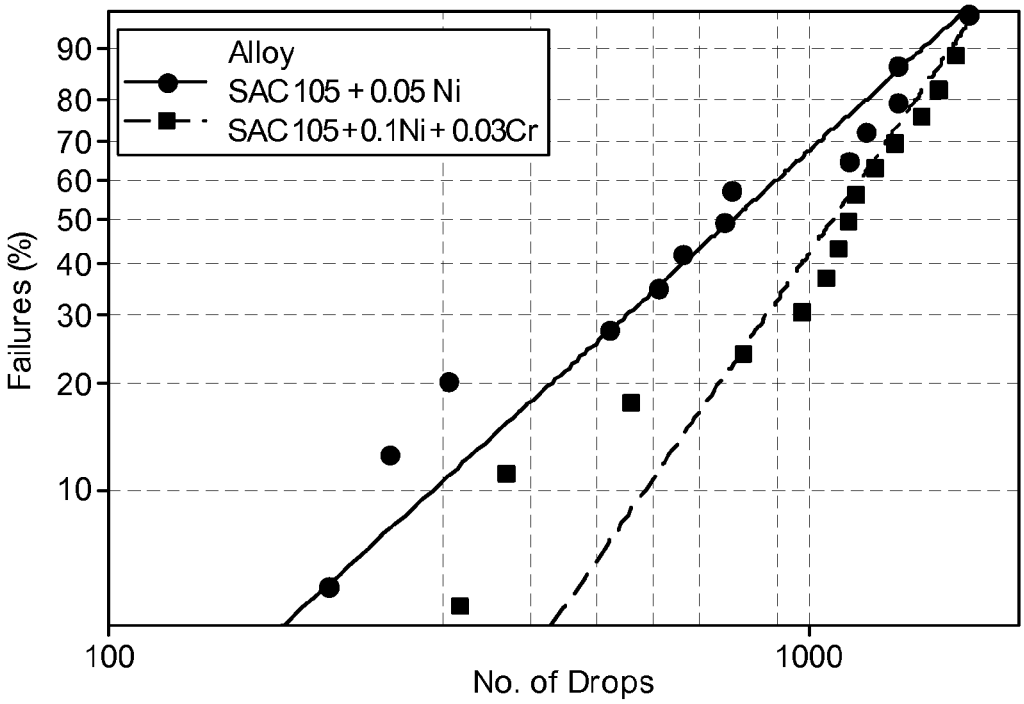
FIG. 3 is a graph showing drop shock test data (Weibull statistics) for Ni and Ni+Cr additions to SnAgCu alloy. The data were obtained according to the method described in Example 17.
Figure 4:
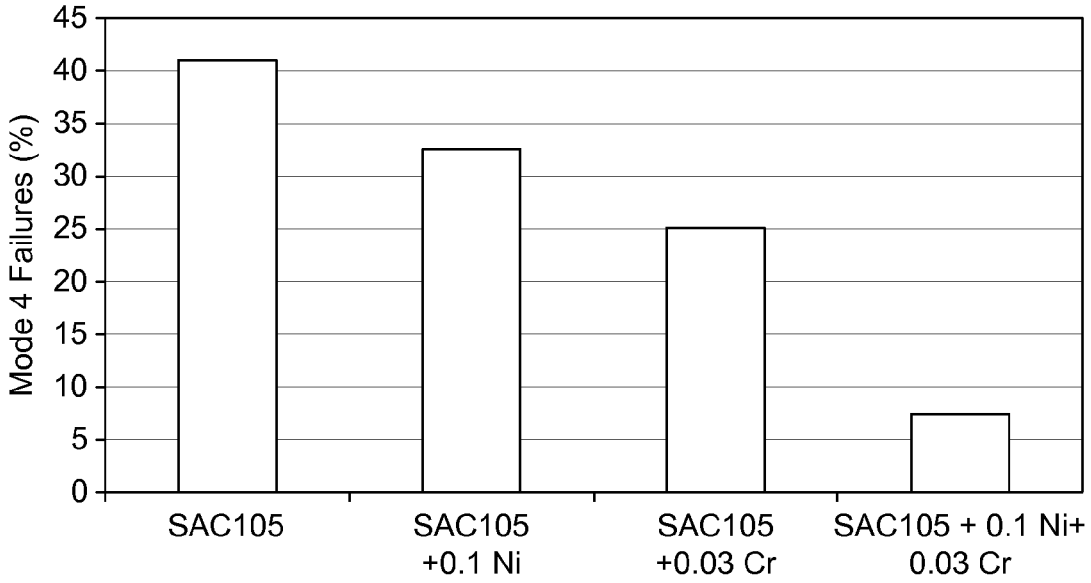
FIG. 4 is a graph showing high speed ball pull test data for Ni, Cr, and Ni+Cr additions to SnAgCu alloy. The data were obtained according to the method described in Example 17.

In the context of this example, FIGS. 1 through 4 are graphs showing the following:

FIG. 1 shows the effect of Ni on solder spread for alloy SAC105 on Cu-OSP;

FIGS. 2*a* and 2*b* show the effect of Ni and Cr on solder spread for alloy SAC105 on Cu-OSP (FIG. 2A) and alloys SAC105, SAC101 and SACX on Cu-OSP (FIG. 2B);

FIG. 3 shows drop shock test data (Weibull statistics) for Ni and Ni+Cr additions to alloy SAC105;

FIG. 4 shows high speed ball pull test data for Ni, Cr, and Ni+Cr additions to alloy SAC105.

Experiments were carried out on solder alloys of the invention according to the following experimental procedures:

Ball pull tests are well known in the field of metallurgy and solder alloys. The experimental work was conducted on Dage 4000 and Dage 4000 HS Ball Pull and Ball Shear systems. The Dage 4000 machine is capable of performing ball pull test at speeds up to 15 mm/sec while the Dage 4000 HS can do the same test up to 1000 mm/sec. All the tests were carried out using 18 mil (450 μm) spheres assembled on CABGA100 substrates and 12 mil (300 μm) spheres assembled on CBGA84 substrates with NiAu pad finish. Spheres were assembled using a water-soluble paste flux (Alpha WS9180-M3) that was stencil printed on the substrates. Spheres were placed using a simple manual alignment assembly setup and reflowed in air, in a seven-zone convection reflow oven.

With regard to the alloys tested, three low silver SnAgCu base alloys were used having the silver, copper, bismuth, and tin contents shown in the below table I:

TABLE I

| Identifier | Tin Content | Silver Content (wt. %) | Copper Content (wt. %) | Bismuth Content (wt. %) |
|---|---|---|---|---|
| SAC105 | Balance | 1.0 | 0.5 | |
| SAC101 | Balance | 1.0 | 0.1 | |
| SAC0307 | Balance | 0.3 | 0.7 | |
| SACX | Balance | 0.3 | 0.7 | 0.1 |

Ni and Cr (and also Bi) were added to these base alloys in varying amounts to form the following alloy compositions:

Base alloy: SAC105 modified with Ni as shown

Ag 1 wt %

Cu 0.5 wt %

Ni 0 wt %, 0.05 wt %, 0.10 wt % or 0.50 wt % and remainder tin

Base Alloy: SAC105 modified by adding Ni and Cr as shown

Ag 1 wt %

Cu 0.5 wt %

Ni 0 wt %, 0.05 wt %, 0.10 wt % or 0.50 wt %

Cr 0.03 wt % and remainder tin

Base alloy: SAC101 modified with Ni as shown

Ag 1 wt %

Cu 0.1 wt %

Ni 0 wt %, 0.05 wt %, 0.10 wt % or 0.50 wt % and remainder tin

Base Alloy: SAC101 modified by adding Ni and Cr as shown

Ag 1 wt %

Cu 0.1 wt %

Ni 0 wt %, 0.05 wt %, 0.10 wt % or 0.50 wt %

Cr 0.03 wt %, 0.05 wt % and remainder tin

Base alloy: SAC307 modified with Ni as shown

Ag 0.3 wt %

| | |
|---|---|
| Cu | 0.7 wt % |
| Ni | 0 wt %, 0.05 wt %, 0.10 wt % or 0.50 wt % |
| and remainder tin | |

Base Alloy: SAC307 modified by adding Ni and Cr as shown

| | |
|---|---|
| Ag | 0.3 wt % |
| Cu | 0.7 wt % |
| Ni | 0 wt %, 0.05 wt %, 0.10 wt % or 0.50 wt % |
| Cr | 0.03 wt % |
| and remainder tin | |

Base alloy: SACX modified with Ni as shown

| | |
|---|---|
| Ag | 0.3 wt % |
| Cu | 0.7 wt % |
| Ni | 0 wt %, 0.05 wt %, 0.10 wt % or 0.50 wt % |

-continued

| | |
|---|---|
| Bi | 0.1 wt % |
| and remainder tin | |

Base Alloy: SACX modified by adding Ni and Cr as shown

| | |
|---|---|
| Ag | 0.3 wt % |
| Cu | 0.7 wt % |
| Ni | 0 wt %, 0.05 wt %, 0.10 wt % or 0.50 wt % |
| Cr | 0.03 wt % |
| Bi | 0.1 wt % |
| and remainder tin | |

Two reference alloys were also tested having the silver, copper, and tin contents shown in the below table II:

TABLE II

| Identifier | Tin Content | Silver Content (wt. %) | Copper Content (wt. %) |
|---|---|---|---|
| SAC405 | Balance | 4.0 | 0.5 |
| SAC305 | Balance | 3.0 | 0.5 |

The alloys were prepared by melting Sn in a cast iron crucible (alternatively a ceramic crucible can be used). To the molten Sn, was added alloys of Sn—Cu, Sn—Ag and Sn—Ni of appropriate composition and amount to obtain the desired final alloy chemistry. These additions were made with the alloy bath temperature at approximately 350° C. The Cr was added by alloying it via the Cu component.

The alloy compositions were then jetted as a metal stream into an inerted vertical column. The metal stream was spherodised by the application of magnetostrictive vibrational energy applied through the melt pot and at or near the exit orifice.

Equally, the alloy composition could be punched and then spherodised as a sphere.

The alloy, provided in the form of a sphere, was applied to a ball grid array joint or chip scale package. Flux was printed or pin transferred to the pads of a CSP. The spheres were then pick and placed or shaken through a stencil onto the fluxed pads. The package was then reflowed in a standard reflow oven at a peak temperature of between 240° C. and 260° C.

Failed samples were categorized by failure mode:—

Mode 1—Pad failure: The whole pad comes off the substrate indicative of a board or substrate quality problem.

Mode 2—Ball Failure/Neck Break: Failure occurs in the bulk of the solder material indicative of a ductile failure. This is the preferred failure mode.

Mode 3—Ball Extrusion: This occurs because of improper placement of the pull tool or a solder that is too soft.

Mode 4—Joint failure/IMC failure: Failure occurs at the solder pad interface. This failure may have a larger peak force and is predominantly a brittle failure.

As will be appreciated, for BGAs and CSPs, ball pull and ball shear tests can be used to evaluate solder sphere performance. High shear rate and high speed ball pull using the DAGE 4000HS emulate drop shock performance. Further, following high temperature (150° C.) aging and the growth of IMC phases, standard ball pull and shear using a DAGE 4000 can reproduce drop shock results. We report here a combination of high speed ball pull and drop shock tests using a Lansmont Drop Shock tower on CABGA100 assemblies.

In addition to high strain rate tests (e.g., high-speed ball pull and drop shock), alloy wetting/spread behaviour was also investigated. 12 mil (0.305 mm) spheres were placed on stencil printed flux on Cu-OSP coupons and reflowed in a seven zone convection oven in air. OSP coupons were used as the poor wetting on OSP is more discriminatory. After reflow the coupons were cleaned in hot water to remove any flux residue. During reflow the solder wets the surface and spreads around. The area of the wetted surface is measured and the spread factor is determined as the fractional increase in area relative to the projected cross-section of the sphere.

Results

Drop shock test data on SAC405, SAC305, SAC105, SAC101 and SACX performed with CABGA100 components assembled with 18 mil (0.457 mm) spheres indicates that the high Ag alloys (i.e. SAC405 and SAC305) tended to fail at lower cycles than the low Ag alloys (i.e. SAC105, SAC101 and SACX). This is probably due to the lower modulus of the lower alloy solder and may be an important factor in selecting solder alloys for high strain rate applications.

The solder spread was measured with different levels of Ni addition on several different base alloys (see FIG. 1). The reproducible optimum level for SAC105 was approximately 0.05% Ni. The deterioration in spread at higher Ni levels was thought to be due to the formation of nickel oxides although interestingly good spread was achieved for increasing levels of Ni in SAC 101, SAC105 and SACX to over 0.1%.

Ball pull results indicated that there was a reproducible correlation between improved ball pull and solder spread. Approximately 0.05% Ni appears to be optimum level for both. The same was also confirmed by drop shock test results for SAC105 with 0.05% Ni and 0.5% Ni. The performance with 0.5% Ni is poorer than 0.05% Ni.

Cr had a zero to negative effect on solder spread. However, in conjunction with Ni, a further improvement in spread was observed. FIGS. 2*a* and 2*b* are interaction plots showing Ni and Cr levels in SAC105, SAC101 and SACX. A strong interaction was present.

It is in the area of mechanical properties that the addition of Ni and Cr is most effective. FIG. 3 is a graph comparing drop shock for SAC105 with Ni, and SAC105 with Ni and Cr additions. While Ni on its own provided an improvement in mechanical properties, the presence of both Ni and Cr produced a much greater effect. This was also demonstrated by the high speed ball pull results shown in FIG. 4. SAC105 with 0.05% Ni showed approximately 30% decrease in mode 4 failures in high-speed ball pull compared to SAC105 with no additions. Similarly 0.1% Ni and 0.5% Ni additions to SAC105 resulted in approximately 20% and 15% decreases in mode 4 failures respectively as compared to plain SAC105. A 0.03% Cr addition to SAC105 reduced the fraction of mode 4 failures by approximately 40%. Importantly, and similarly to the solder spread results, there appeared to be a synergistic effect between Ni and Cr. While 0.03% Cr alone provided an improvement, the addition together with 0.1% Ni resulted in a greater than 80% decrease in mode 4 brittle failures. As a consequence, it may be concluded that the collective effect of Ni and Cr additions was greater than the sum of the individual effects. Along with improved high strain rate behavior, Ni offered two other benefits. At the optimum addition level (approx. 0.05%), SAC alloys with Ni showed greater solder spread, and Ni also provided a measurable improvement in solder tarnish resistance, an important consideration in BGA and CSP assembly.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

We claim:

1. An alloy suitable for use in a ball grid array or chip scale package, the alloy comprising:

from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

2. An alloy as claimed in claim 1 comprising from 0.03 to 0.07 wt % nickel.

3. An alloy as claimed in claim 1 comprising from 0.04 to 0.08 wt % nickel.

4. An alloy as claimed in claim 1 comprising from 0.01 to 0.07 wt % chromium.

5. An alloy as claimed in claim 4 comprising from 0.02 to 0.06 wt % chromium.

6. An alloy as claimed in claim 1 comprising from 0.1 to 1 wt. % Cu.

7. An alloy as claimed in claim 6 comprising from 0.1 to 0.9 wt. % Cu.

8. An alloy as claimed in claim 1 comprising from 0.1 to 1 wt. % Ag.

9. An alloy as claimed in claim 8 comprising from 0.1 to 0.5 wt. % Ag.

10. An alloy as claimed in claim 1 comprising from 0.02-0.2 wt. % of at least one of cobalt and iron.

11. An alloy as claimed in claim 1 comprising from 0.02-0.3 wt. % iron.

12. An alloy as claimed in claim 1 comprising from 0.01-0.15 wt. % manganese.

13. An alloy as claimed in claim 1 comprising from 0.05-0.3 wt. % indium.

14. An alloy as claimed in claim 1 comprising from 0.01-0.3 wt. % silicon.

15. An alloy as claimed in claim 1 comprising from 0.008-0.3 wt. % aluminum.

16. An alloy as claimed in claim 1 comprising from 0.01-0.3 wt. % zinc.

17. An alloy as claimed in claim 1 comprising from 0.05-1 wt. % antimony.

18. An alloy as claimed in claim 1 comprising from 0.05 to 1 wt. % bismuth.

19. An alloy as claimed in claim 1, wherein said one or more rare earth elements comprises one or more elements selected from cerium, lanthanum, neodymium and praseodymium.

20. An alloy as claimed in claim 1 comprising from 0.1 to 0.8 wt. % Cu, from 0.1 to 1.5 wt. % Ag, from 0.03 to 0.15 wt % nickel and from 0.01 to 0.07 wt % chromium.

21. An alloy as claimed in claim 1 in the form of a bar, a stick, a solid or flux cored wire, a foil or strip, a preform, or a powder or paste (powder plus flux blend), or solder spheres for use in ball grid array joints, or a pre-formed solder piece.

22. An alloy as claimed in claim 1 wherein the alloy demonstrates a greater than 80% decrease in Mode 4 brittle failures in comparison to a comparative alloy having the same constituents except having no Ni and Cr, wherein Mode 4 failure is a joint failure and intermetallic compound failure occurring at a solder pad interface.

23. The alloy of claim 1 consisting essentially of said:

from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

24. The alloy of claim 1 consisting of said:

from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

25. The alloy of claim 1 consisting essentially of said:

from 0.05-1.5 wt. % copper;
from 0.1-2 wt. % silver;
from 0.005-0.3 wt % nickel;

from 0.003-0.3 wt % chromium;
from 0-0.1 wt. % phosphorus;
from 0-2 wt. % bismuth;
the balance tin, together with unavoidable impurities.

26. The alloy of claim 1 consisting of said:
from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-2 wt. % bismuth;
the balance tin, together with unavoidable impurities.

27. A soldered ball grid array or chip scale package joint comprising an alloy as defined in claim 1.

28. The soldered joint of claim 27 wherein the alloy comprises 0.05 to 1 wt % bismuth.

29. The soldered joint of claim 27 wherein the alloy comprises from 0.1 to 0.8 wt. % Cu, from 0.1 to 1.5 wt. % Ag, from 0.03 to 0.15 wt % nickel and from 0.01 to 0.07 wt % chromium.

30. The soldered joint of claim 27 wherein the alloy consists essentially of said:
from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-2 wt. % bismuth;
the balance tin, together with unavoidable impurities.

31. The soldered joint of claim 27 wherein the alloy demonstrates a greater than 80% decrease in Mode 4 brittle failures in comparison to a comparative alloy having the same constituents except having no Ni and Cr, wherein Mode 4 failure is a joint failure and intermetallic compound failure occurring at a solder pad interface.

32. An alloy suitable for use in a ball grid array or chip scale package, the alloy comprising:
from 0.5-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

33. An alloy as claimed in claim 32 comprising from 0.03 to 0.07 wt % nickel.

34. An alloy as claimed in claim 32 comprising from 0.01 to 0.07 wt % chromium.

35. An alloy as claimed in claim 32 comprising from 0.5 to 0.9 wt % copper.

36. An alloy as claimed in claim 32 comprising from 0.03 to 0.07 wt % nickel, from 0.01 to 0.07 wt % chromium, and from 0.5 to 0.9 wt % copper.

37. An alloy as claimed in claim 32 wherein the Ni and Cr are present in a sum concentration between 0.01 and 0.2 wt %.

38. An alloy as claimed in claim 32 wherein the Ni and Cr are present in a sum concentrations between 0.05 and 0.12 wt %.

39. An alloy suitable for use in a ball grid array or chip scale package, the alloy comprising:
from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0.01-0.3 wt. % magnesium;
from 0-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

40. An alloy suitable for use in a ball grid array or chip scale package, the alloy comprising:
from 0.05-1.5 wt. % copper;
from 0.1-2 wt. % silver;
from 0.005-0.3 wt % nickel;
from 0.003-0.3 wt % chromium;
from 0-0.1 wt. % phosphorus;
from 0-0.1 wt. % germanium;
from 0-0.1 wt. % gallium;
from 0-0.3 wt. % of one or more rare earth elements;
from 0-0.3 wt. % indium;
from 0-0.3 wt. % magnesium;
from 0.01-0.3 wt. % calcium;
from 0-0.3 wt. % silicon;
from 0-0.3 wt. % aluminum;
from 0-0.3 wt. % zinc;
from 0-2 wt. % bismuth;
from 0-1 wt. % antimony;
from 0-0.2 wt % manganese;
from 0-0.3 wt % cobalt;
from 0-0.3 wt % iron;
from 0-0.1 wt % zirconium; and
the balance tin, together with unavoidable impurities.

* * * * *